United States Patent [19]

DeMejo et al.

[11] Patent Number: 5,032,484

[45] Date of Patent: Jul. 16, 1991

[54] POLYETHYLENEIMINE-CONTAINING TONER COMPOSITIONS

[75] Inventors: Lawrence P. DeMejo, Rochester; Joseph A. Pavlisko, Pittsford, both of N.Y.

[73] Assignee: Eastman Kodak Company, Rochester, N.Y.

[21] Appl. No.: 457,609

[22] Filed: Dec. 27, 1989

[51] Int. Cl.[5] ..... G03G 9/00

[52] U.S. Cl. ..... 430/110; 430/109

[58] Field of Search ..... 430/109, 110

[56] References Cited

U.S. PATENT DOCUMENTS

| | | | |
|---|---|---|---|
| 4,517,272 | 5/1985 | Jadwin et al. . | |
| 4,532,187 | 7/1985 | Hoenig et al. | 428/457 |
| 4,758,491 | 7/1988 | Alexandrovich et al. | 430/110 |
| 4,812,377 | 3/1989 | Wilson et al. . | |
| 4,868,086 | 9/1989 | Ohtani et al. | 430/110 |

FOREIGN PATENT DOCUMENTS

| | | |
|---|---|---|
| 0241223 | 10/1987 | European Pat. Off. . |
| 57-182753 | 11/1982 | Japan . |
| 59-220751 | 12/1984 | Japan . |
| 59-226357 | 12/1984 | Japan . |
| 63-199365 | 8/1988 | Japan . |

*Primary Examiner*—Marion E. McCamish
*Assistant Examiner*—S. C. Crossan
*Attorney, Agent, or Firm*—Dressler, Goldsmith, Shore, Sutker & Milnamow, Ltd.

[57] ABSTRACT

Toner compositions of toner particles and magnetic carrier particles are provided. The toner particles contain incorporated therein a fatty acid amine derived charge control agent, a polydimethylsiloxane flow control agent and low molecular weight, particulate polyethylineimine particles. The compositions display excellent paper adhering characteristics after heat fusion thereto and excellent carrier developer charging characteristics.

9 Claims, No Drawings

POLYETHYLENEIMINE-CONTAINING TONER COMPOSITIONS

FIELD OF THE INVENTION

This invention is in the field of polyethyleneimine-containing toner powder compositions.

BACKGROUND OF THE INVENTION

European Patent Application No. 0,241,223 discloses toner compositions which are produced by monomer polymerization in the presence of polyethyleneimine as a dispersant. Also Japanese Patent Application Nos. J63199365-A, J59226357A, J59220151, and J57182753 teach toner compositions containing a binder, a charge control agent, a colorant and polyethyleneimine. In such prior art toner compositions, the polyethyleneimine is a high molecular weight, branched, amorphous material which is typically water soluble.

Commercial polyethyleneimines can be characterized as possessing a highly branched structure containing primary, secondary, and tertiary amine groups. This structure leads to an amorphous material with such a significant hydrophilic character that these commercial materials are provided as aqueous solutions. Addition of this type of polyethyleneimine in toners results in depressed environmental keeping properties and developer RH sensitivity. The utilization of a linear crystalline polyethyleneimines composed of only secondary amine groups, as described by E. J. Goethals and K. J. Weyts, Polymer Bulletin, Volume 19, 13–19 (1988), and also by T. Saegusa et. al., Macromolecules, Volume 15, 707 (1982), circumvents these undesirable effects while still providing an improvement in toner adhesion. This is accomplished by the polyethleneimine being a separate crystalline phase in the toner particle that does not adversely affect the toner keep properties or developer RH sensitivity, yet when melted in the fusing process contributes in a positive manner to the toner-paper adhesion properties.

In toner compositions wherein toner particles are blended with magnetic carrier particles, particularly coated magnetic carrier particles, it is desirable to reduce flakes, hollow character defects, and carrier particle aging. Substantial improvement in such properties can be achieved by including in the polymeric toner particles a fatty acid amine derivative (preferably a quaternary amine compound) as a charge control agent and a lubricant such as polydimethylsiloxane. Unfortunately, such agents seriously interfere with the ability of the toner particles to adhere strongly to copy paper upon heat fusion. Well adhered, heat fused images are necessary for commercially acceptable quality in electrophotographically-made document copies.

In order to achieve commercially useful toner powders containing such charge control agents and lubricants, it is desirable to include in the toner powder composition at least one agent which minimizes the poor adhesion capacity. Previous efforts to find such an additive, however, have generally failed.

Nothing in the prior art teaches or suggests the use of a low molecular weight, crystalline, particulate polyethyleneimine as an adhesion enhancer for overcoming the adhesion reducing effects of the combination of a fatty acid amine charge control agent and a polydimethylsiloxane lubricant in toner compositions.

SUMMARY OF THE INVENTION

This invention provides toner compositions which display excellent capacity to adhere to paper upon being heat fused.

When combined or mixed with magnetic carrier core particles, these toner particles also result in magnetic developer compositions that are well adapted for producing high quality developed images using electrophotographic magnetic brush development processes and display good developer charging characteristics.

The toner composition comprises a thermoplastic polymer which has dispersed therein colorant, at least one fatty acid amine charge control agent, at least one polydimethylsiloxane lubricant and low molecular weight, crystalline polyethyleneimine.

Other and further advantages, aims, features, and the like will be apparent to those skilled in the art when taken with the appended claims.

DETAILED DESCRIPTION OF THE INVENTION

Toner particles employed in the practice of the present invention have average particle diameters in the range of about 5 to about 30 microns and preferably in the range of about 10 to about 17 microns.

In such toner particles, a thermoplastic polymer functions as a continuous or matrix phase in which are dispersed various additives. This polymer is characterized by being solvent soluble, film forming, and having an intrinsic viscosity in the range of about 0.1 to about 0.8 as measured in a 0.25 weight percent solution of the polymer in dichloromethane at 25° C.

The polymer has a fusing point in the range of about 65 to about 200° C., and preferably in the range of about 65 to about 120° C. The term "fusing point" as used herein refers to the melting point of a resin as measured by a Fisher Johns apparatus, Fisher Scientific Catalog no. 12–144 or equivalent.

The polymer also has a glass transition temperature ($T_g$) which is in the range of about 50 to about 120° C., and preferablY in the range of about 60 to about 100° C. The term "glass transition temperature" ($T_g$) as used herein refers to the temperature at which a polymer material changes from a glassy polymer to a rubbery polymer. This temperature $(T)_g$can be measured by differential thermal analysis as disclosed in "Techniques and Methods of Polymer Evaluation", Vol. 1, Marcel Dekker, Inc., N.Y. 1966.

Suitable polymers can have various chemical structures. For example, they can be selected from among polyesters, polyesteramides, polycarbonates, polyolefins, polyacrylics, polystyrene and styrene copolymers, and the like. Presently preferred polymers are branched chain polyesters, and styrene copolymers. Methods for making such polymers are known to the prior art.

Any convenient procedure can be used for preparing the toner powders. For example, one presently preferred procedure involves preliminarily preparing a particulate blend of the thermoplastic polymer, colorant, and other additives.

Such a blend comprises the polymer and:

(a) about 3 to about 20 parts by weight of a colorant per 100 parts by weight of polymer;

(b) about 1 to about 5 parts by weight of at least one fatty acid amine charge control agent per 100 parts by weight of polymer;

(c) about 1 to about 5 parts by weight of at least one polydimethylsiloxane; and (d) about 1 to about 25 parts by weight of at least one crystalline polyethyleneimine having a molecular weight in the range of about 1000 to about 25,000.

Preferably, the colorant is a pigment. A presently preferred pigment is a carbon black pigment which has an ultimate particle size in the range of about 0.01 to about 2.0 microns.

Preferably, the charge control agent is a quaternary ammonium complex derived from a fatty acid tertiary amine which contains a relatively strong charge retaining moiety. Suitable quaternary ammonium salts are disclosed in "Research Disclosure No. 2130", Vol. 210, October, 1981 (published by Industrial Opportunities, Ltd., Homewell, Havant, Hampshire, P09IEF, United Kingdom). A presently preferred quaternary ammonium complex is benzyl dimethyloctadecyl ammonium-3-nitrobenzene sulfonate.

The polydimethylsiloxane is as described in U.S. Pat. No. 4,758,491 and functions as a lubricant.

The blend is melt compounded on a roller mill or in an extruder under conditions that melt the blend. A suitable extruder is a twin screw extruder, or the like. The toner melt is then crushed and ground in a mill, such as a Trost TM T-15 mill (available commercially from Colt Industries), and the particles are then classified, such as with an Alpine Multi-Plex TM Classifier model 100 MZR, so that the toner particles produced have a desired size in the range above indicated.

The blending is preferably heated at 130° C. for about 15 minutes on a two roll mill. At these conditions the polyethyleneimine melts and phase separates into discrete microphases as the toner cools below its $T_g$.

In the extruded, ground and sized toner particles, the individual particles have the polyethyleneimine dispersed therein as discrete particulate crystalline bodies where average diameters are in the size range of about 0.1 to about 1 micron.

The toner particles of this invention are suitable for use in electrostatic latent image development using conventional development processes. However, the toner particles are particularly well adapted for blending with magnetic carrier particles, especially coated magnetic carrier particles, for purposes of producing two-component dry electrographic developer compositions which can be employed in combination with a magnetic applicator apparatus to develop latent electrostatic images. Such a magnetic applicator apparatus is well known and typically comprises a rotatable magnetic core and an outer, nonmagnetizable shell; see, for example, the applicators taught in U.S. Pat. Nos. 4,546,060; 4,345,014; 4,235,194; 4,239,845; and 3,552,355.

Magnetic carrier particles employed in the practice of this invention can have average particle diameters in the range of about 0.1 to about 60 microns , Such particles can be comprised, for example, of magnetic materials, such as magnetite, hematite, and ferrite; metals, such as iron, cobalt and nickel; alloys of these metals with other metals, such as aluminum, cobalt, copper, lead, magnesium, tin, zinc, antimony, beryllium, bismuth, cadmium, calcium, manganese, selenium, titanium, tungsten, vanadium, mixtures thereof, and the like. Presently preferred such particles are comprised of ferrite or gamma ferric oxide.

Typically a toner composition can employ about 70 to about 99 weight percent of such magnetic carrier particles, and, correspondingly, about 1 to about 30 weight percent of such toner particles.

The carrier particles can be coated with a material which causes the coated carrier to charge as desired. Such a coating can be applied to carrier particles by a variety of known techniques, including solvent coating, spray applications, plating, tumbling, melt coating, or the like. The coating material can be an organic polymer, such as taught in U.S. Pat. Nos. 3,795,617; 3,795,618; 4,076,857; or the like. The exact choice of coating material depends upon the triboelectric relationship desired with the toner particles to be compounded with such coated carrier particles. Typically, the quantity of coating material employed is in the range of about 0.1 to about 15 parts by weight of material (preferably a polymer) per 100 parts by weight of magnetic carrier particles. For example, for use with toner particles which are desired to be positively charged, the polymer used for carrier particle coating can be, for example, a fluorocarbon polymer, such as poly(tetrafluoroethylene), poly(vinylidene fluoride), poly(vinylidene fluoride-cotetrafluoroethylene), or the like.

Magnetic carrier particles employed in the practice of this invention preferably have a magnetic coercivity of at least about 100 gauss, and more preferably of at least about 300 gauss, when magnetically saturated, and preferably such particles have an induced magnetic moment of at least about 5 EMU/gm, and more preferably at least about 20 EMU/gm, when in an applied field of 1000 gauss.

In a toner composition comprised of magnetic carrier particles and toner particles, the charging level of the toner particles is preferably at least about 5 microcoulombs per gram of toner particles. The polarity of the toner charge can be either positive or negative.

The toner particles of this invention display excellent adhesion characteristics to paper after being heat fused thereto as illustrated by the examples below. This adhesion is attributed to the presence of the particular type of polyethyleneimine employed in the practice of this invention.

The developer compositions of toner particles of this invention and magnetic carrier particles display good developer characteristics as illustrated by the examples below. This good charging characteristic is also attributed to the particular type of polyethyleneimine employed in the practice of this invention.

The invention is illustrated by the following examples:

EXAMPLE 1

Preparation of Toner Particles

An amorphous branched polyester polymer was prepared. The polymer had an intrinsic viscosity of 0.3 L/g in dichloromethane at 25° C., and a glass transition temperature of 67° C. The polymer was melt compounded with (a) a carbon black pigment (obtained commercially from Cabot Corp. as Regal TM 300) which had ultimate particle sizes in the range of about 0.01 to about 2 microns, (b) a quaternary ammonium compound, (c) a polydimethylsiloxane block copolymer, and (d) a crystalline polyethyleneimine having a molecular weight of about 2,000 and a melting point of 55° C. The starting blend compositions were as follows:

TABLE I

| Component | Parts by Weight blend 1.1 | blend 1.2 | blend 1.3 |
|---|---|---|---|
| (1) branched polyester polymer | 100.0 | 100.0 | 100.0 |
| (2) carbon black pigment | 5.0 | 5.0 | 5.0 |
| (3) benzyldimethyloctadecyl ammonium-3-nitro-benzenesulfonate | 1.5 | 1.5 | 1.5 |
| (4) polydimethylsiloxane copolymer | 2.0 | 2.0 | 2.0 |
| (5) polyethyleneimine | (none) | 2.0 | 5.0 |

Each of these blends was compounded using a two roll mill.

Each toner melt was cooled and ground in a modified Trost T-15 mill obtained from Colt Industries, Company, and the ground material was classified on an Alpine Multi-Plex Classifier model 100 MZR to separate particles in the size range of about 12 to about 15 microns, as measured on a HIAC particle size analyzer. The extrusion conditions were chosen to achieve a surface concentration of the siloxane corresponding to a value of 0.025 ± 0.005 Si/C (atomic %) ratio as determined by x-ray photoelectron spectroscopy using a Hewlett-Packard 5950A spectrometer or a sink rate of 0.4 ± 0.2 mg/sec. Sink rate measures the time required for the sample to be wet by a surfactant solution and is related to surface energy by a procedure in which 200 mL of surfactant is poured into a 1 liter beaker, 200 mg of toner powder is poured onto the liquid/vapor interface. The time required for the powder to be wetted is measured and the sink rate is recorded in units of mg/sec. It is desired for the product toner particles to have a laydown number which is not greater than 0.45 mg/cm$^2$ at a reflection density of 1.

EXAMPLE 2

Preparation of Magnetic Developer Composition

Ferrite particles were coated with 1 pph of a fluorocarbon resin (Kynar TM available from Pennwalt), the carrier being of a type described in U.S. Pat. No. 4,546,060.

A developer composition comprised on a 100 weight percent basis of 87 weight percent of such coated ferrite particles and 13 weight percent of each of the toner particles products of Example 1 was prepared by simple mixing.

The unexercised toner charge of this developer was found to be 9–10 microcoulombs per gram using a 0.5 second charge procedure.

EXAMPLE 3

Preparation of Toner Powder

The procedure of Example 1 was repeated using the same components, but the following starting blend compositions:

TABLE II

| Component | Parts by Weight blend 3.1 | blend 3.2 |
|---|---|---|
| (1) branched polyester polymer | 100.0 | 100.0 |
| (2) carbon black pigment | 6.0 | 6.0 |
| (3) benzyldimethyloctadecyl ammonium-3-nitro-benzenesulfonate | 1.5 | 1.5 |
| (4) polydimethylsiloxane | 4.0 | 4.0 |
| (5) polyethyleneimine | (none) | 5 |

EXAMPLE 4

Preparation of Magnetic Developer Composition

The procedure of Example 2 was repeated using the toner powder of Example 3.

EXAMPLE 5

Evaluation of Adhesion

Each of the toner particles produced in Example 1 was evaluated to determine its adhesion index by a standard pendulum adhesion test. The results are shown in Table III below:

TABLE III

| TONER EX. NO. | pph PEI | ADHESION INDEX FUSING (SIMPLEX/RED RUBBER 150) OF 250 | 275 | 300 | 325 |
|---|---|---|---|---|---|
| 1.1 | 0 | 17 | 41 | 79 | 100 |
| 1.2 | 2 | 23 | 41 | 99 | |
| 1.3 | 5 | 49 | 100 | | |

The results show that adhesion is substantially improved by polyethyleneimine with the amount of the increase being proportional to the amount of polyethyleneimine.

EXAMPLE 6

Evaluation of Adhesion

Each of the toner particles produced in Example 3 was evaluated to determine its adhesion index by a standard pendulum adhesion test. The results are shown in Table IV below:

TABLE IV

| TONER EX. NO. | pph PEI | (VITON/SILVERSTONE 250) 280 | 300 | 320 | 340 | 360 | 380 |
|---|---|---|---|---|---|---|---|
| 3.1 | 0 | 15.6 | 22.5 | 26.9 | 33.0 | 41.8 | 91.7 |
| 3.2 | 5 | 20.1 | 26.6 | 52.7 | 53.1 | 77.9 | 99.6 |

The results are comparable to those obtained in Example 5.

The invention has been described in detail with particular reference to preferred embodiments thereof, but it will be understood that variations and modifications can be effected within the spirit and scope of the invention.

We claim:

1. A toner composition having adhesion capacity to paper after being heat fused thereto comprising toner particles having average particle diameters in the range of about 5 to 30 microns, said toner particles comprising a thermoplastic polymer having a glass transition temperature in the range of about 50 to about 120° C., and said polymer having dispersed therein about 3 to about 20 parts by weight of a colorant per 100 parts by weight of said polymer; about 1 to about 5 parts by weight of at least one benzene sulfonate-fatty acid ammonium salt per 100 parts by weight of said polymer; about 1 to about 5 parts by weight of at least one polydimethylsiloxane copolymer per 100 parts by weight of said polymer; and about 1 to about 10 parts by weight of at least one crystalline polyethyleneimine per 100 parts by weight of said polymer.

2. The toner composition of claim 1 which is admixed with magnetic carrier particles.

3. The toner composition of claim 2 wherein said magnetic carrier particles have average particle diameters in the range of about 0.1 to about 60 microns and are selected from the group consisting of ferrites and gamma ferric oxide.

4. The toner composition of claim 2 wherein said magnetic carrier particles are coated with about 0.1 to about 15 parts by weight of a polymer per 100 parts by weight of said magnetic carrier particles.

5. The toner composition of claim 2 which comprises about 70 to about 99 weight percent of said magnetic carrier particles and about 1 to about 30 weight percent of said toner particles.

6. The toner composition of claim 1 wherein said thermoplastic polymer comprises a branched chain polymer selected from the group consisting of polyesters and polyester amides.

7. The toner composition of claims 1 wherein said colorant comprises a carbon black pigment having an ultimate particle size in the range of about 0.01 to about 2 microns.

8. The toner composition of claim 1 wherein said charge control agent is benzyldimethyloctadecylammonium-3-nitrobenzene sulfonate.

9. The toner composition of claim 1 wherein said polyethyleneimine has a molecular weight in the range of about 1,000 to about 25,000, and a melting point in the range of about 50 to about 60° C.

* * * * *